US009989233B2

(12) United States Patent
Dexter et al.

(10) Patent No.: US 9,989,233 B2
(45) Date of Patent: Jun. 5, 2018

(54) RUGGED LIGHT ASSEMBLY HAVING IMPROVED RESILIENCY AND METHOD FOR MAKING THE SAME

(71) Applicant: Moore Holding Group, LLC, Cary, NC (US)

(72) Inventors: Timothy Ryan Dexter, Angier, NC (US); Allen Wendell Moore, Cary, NC (US)

(73) Assignee: Moore Holding Group, LLC, Cary, NC (US)

( * ) Notice: Subject to any disclaimer, the term of this patent is extended or adjusted under 35 U.S.C. 154(b) by 311 days.

(21) Appl. No.: 14/718,239

(22) Filed: May 21, 2015

(65) Prior Publication Data

US 2015/0338080 A1 Nov. 26, 2015

Related U.S. Application Data

(60) Provisional application No. 62/001,671, filed on May 22, 2014.

(51) Int. Cl.

| | |
|---|---|
| ***F21S 4/00*** | (2016.01) |
| ***F21V 31/00*** | (2006.01) |
| ***F21V 23/06*** | (2006.01) |
| ***F21V 23/02*** | (2006.01) |
| ***F21V 15/01*** | (2006.01) |
| ***F21V 29/70*** | (2015.01) |
| ***F21S 4/22*** | (2016.01) |
| ***F21V 23/00*** | (2015.01) |
| *F21V 31/04* | (2006.01) |
| *F21Y 103/10* | (2016.01) |
| *F21Y 115/10* | (2016.01) |

(52) U.S. Cl.

CPC ..... *F21V 23/06* (2013.01); *F21S 4/22* (2016.01); *F21V 15/01* (2013.01); *F21V 23/002* (2013.01); *F21V 23/02* (2013.01); *F21V 29/70* (2015.01); *F21V 31/005* (2013.01); *F21V 31/04* (2013.01); *F21Y 2103/10* (2016.08); *F21Y 2115/10* (2016.08); *Y10T 29/49004* (2015.01)

(58) Field of Classification Search

CPC ..... F21V 23/06; F21V 23/002; F21V 29/70; F21V 15/01; F21V 31/005; F21V 21/32; F21V 31/04; F21V 23/02; F21S 4/22

See application file for complete search history.

(56) References Cited

U.S. PATENT DOCUMENTS 4,439,818 A * 3/1984 Scheib ..... F21V 21/0808 362/221
6,505,955 B1 * 1/2003 Hatjasalo ..... B60Q 1/32 264/171.13

(Continued)

*Primary Examiner* — Anh Mai
*Assistant Examiner* — Arman Fallahkhair
(74) *Attorney, Agent, or Firm* — NK Patent Law, PLLC

(57) ABSTRACT

A rugged lighting assembly is provided. The assembly includes an array of light elements. Respective light elements are flexibly and electrically coupled to each adjacent light element. An overmold bottom casing assembly extends from beneath the array of light elements to a lower surface defined about a lens of the light element. An overmold top casing extends above the array of light elements and into engagement with the overmold bottom casing to form a housing that contains the array of light elements therein. A related method is also provided.

15 Claims, 5 Drawing Sheets

(56) References Cited

U.S. PATENT DOCUMENTS

| | | | | |
|---|---|---|---|---|
| 2005/0146870 | A1* | 7/2005 | Wu | F21S 4/22<br>362/227 |
| 2013/0021811 | A1* | 1/2013 | Goldwater | F21S 4/22<br>362/473 |

* cited by examiner

RUGGED LIGHT ASSEMBLY HAVING IMPROVED RESILIENCY AND METHOD FOR MAKING THE SAME

CROSS-REFERENCE TO RELATED APPLICATIONS

This application claims priority to U.S. Provisional Patent Application No. 62/001,671 filed on May 22, 2014, the entire contents of which are incorporated by reference herein.

TECHNICAL FIELD

The disclosure relates generally toward a rugged light assembly having improved resiliency and a method for making the same, and, more particularly, towards a light assembly that is deformable in use in order to provide improved ruggedness and usability.

BACKGROUND OF THE INVENTION

Much advancement has been made in the lighting industry with the advent of widespread usage of light emitting diodes (LEDs). LEDs have replaced conventional incandescent bulbs in many uses and applications. Traditional incandescent bulbs and LEDs each suffer from a lack of ruggedness in regards to both construction of the assembly containing the light and the bulb or light itself. For example, a trouble lamp may use an incandescent light bulb for lighting purposes, however, the lamp is not well protected and, when used in situations where the light may be subjected to significant handling, the light/lamp may fracture, creating a safety hazard due to release of gases within the light and a safety hazard due to shards of glass created upon breaking of the light. In situations of poor lighting, failure of the conventional light may leave the user in darkness with inherent danger.

Light assemblies are also not sufficiently flexible to deform or otherwise bend when under stress. This also leads to issues with ruggedness of the light assembly where either the light assembly or the light itself is broken or otherwise damaged. Additionally, for light assemblies that have a rigid construction, the assemblies are incapable of broadcasting light from multiple origination points of varying angles for respective lights in an array.

There remains a need for a lighting assembly that addresses these disadvantages associated with conventional assemblies.

SUMMARY

According to one or more embodiments, a rugged lighting assembly is provided. The rugged lighting assembly includes an array of light elements. Each respective light element is flexibly and electrically coupled to each adjacent light element. The lighting assembly includes an overmold bottom casing assembly extending from beneath the array of light elements to a lower surface defined about a lens of the light element and an overmold top casing extending above the array of light elements and into engagement with the overmold bottom casing to form a housing that contains the array of light elements therein.

According to one or more embodiments, the array of light elements are light emitting diodes (LEDs).

According to one or more embodiments, the assembly includes a power cable coupled with the array of light elements and is further configured for being in communication with an electrical power source.

According to one or more embodiments, the assembly includes a driver in series communication with the array of light elements and the power cable for controlling current to the array of light elements.

According to one or more embodiments, the overmold bottom casing is formed from an elastomer.

According to one or more embodiments, the overmold top casing is formed from an elastomer.

According to one or more embodiments, each adjacent light element is flexibly and electrically coupled by a coil assembly.

According to one or more embodiments, the overmold bottom casing extends to cover each of the coil assemblies of the light elements.

According to one or more embodiments, each adjacent light element is flexibly and electrically coupled by a member that is capable of flexation and elongation such that the assembly may be bent in at least one of a yaw, pitch, and roll direction.

According to one or more embodiments, the overmold top casing is transparent to allow light emitted from the array of lights to pass through.

According to one or more embodiments, the overmold top casing is at least partially transparent to allow light emitted from the array of lights to pass through.

According to one or more embodiments, the housing is elongate.

According to one or more embodiments, each respective light of the light array is in series communication.

According to one or more embodiments, each respective light of the light array is in parallel communication.

According to one or more embodiments, the housing is water-tight.

According to one or more embodiments, the overmold top casing is configured for dissipating heat.

According to one or more embodiments, a method of making the assembly described herein is provided. The method includes providing the array of light elements. The method includes placing the array of light elements within a first mold where the light elements are received within corresponding recesses in the mold that are not in fluid communication with the injection area of the first mold such that only a portion of the light elements are covered with injected material. The method includes injecting material into the first mold to form the overmold bottom casing assembly, placing the overmold bottom casing assembly in a second mold, and injecting material into the second mold to form the overmold top casing assembly.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
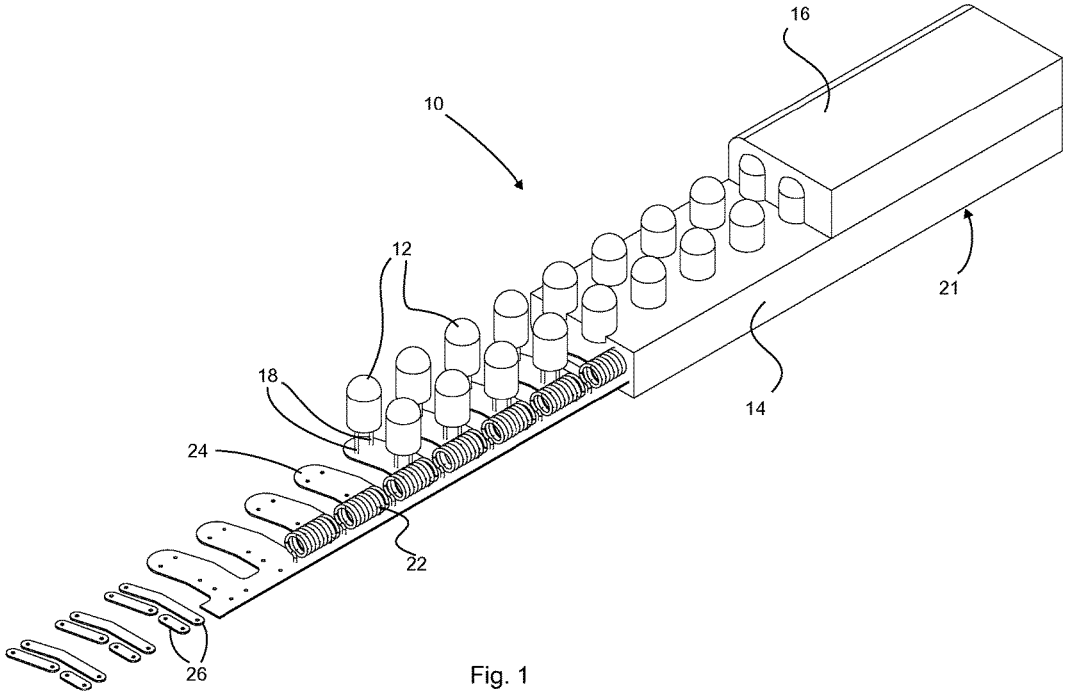
FIG. 1 illustrates a cut away view of a light assembly according to one or more embodiments disclosed herein.
Figure 2:
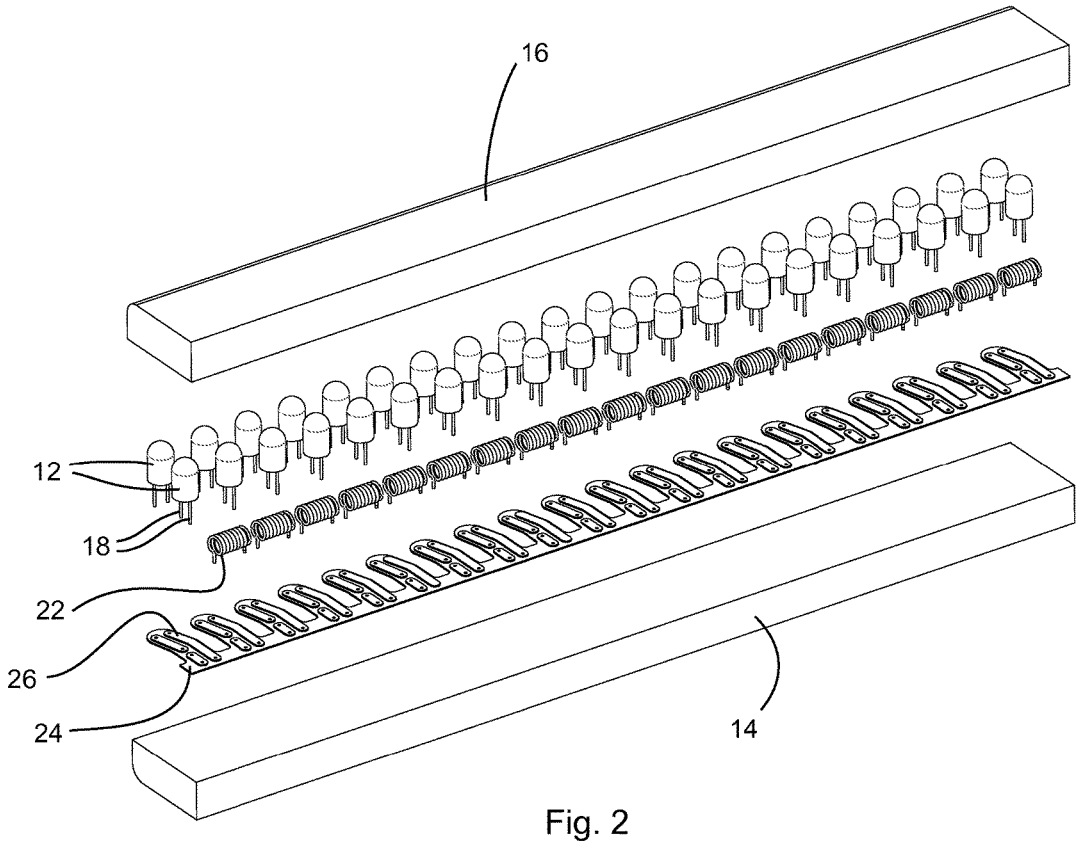
FIG. 2 illustrates an exploded view of a light assembly according to one or more embodiments disclosed herein.

The one or more embodiments disclosed herein provide for a rugged lighting assembly 10 as illustrated in FIG. 1 and FIG. 2. The rugged lighting assembly 10 is illustrated as an elongated lighting assembly in the one or more drawings, but is not so limited in construction or design. As used herein, rugged may mean having improved structural characteristics with an ability to withstand impacts that other light assemblies may not be able to. The light assembly 10 may also be configured for being deformable and bendable in appropriate circumstances.

The light assembly 10 may include an array of light elements 12. The light elements 12 are shown as sequential pairs of Light Emitting Diodes (LEDs), though any appropriately configured light element may be employed. As illustrated, each LED may include a pair of connection elements 18 that interconnect within a recess of a flex circuit board 24. Flex circuit board 24 may or may not be current carrying. As configured and illustrated, each respective light element 12 is flexibly and electrically coupled to each adjacent light element 12. In the embodiment illustrated in FIG. 1, the light elements 12 are flexibly and electrically coupled via a flexible coil assembly 22 that extends into electrical contact with circuit portions 26 to thereby connect the light elements in a series connection. The coil assembly 26, flex circuit board 24, and connection elements 18 collectively form a connector for electrically communicating each adjacent light assembly. In the one or more embodiments shown, coil assembly 26 provides both the flexible characteristics and current carrying characteristics of the improvements represented by assembly 10. This relationship is shown in greater detail in FIG. 6 and FIG. 7, with a further alternate embodiment shown in FIG. 8.

Light elements 12 are illustrated as one embodiment, but may include surface mount chip LEDs or any other type of light emitting or illuminating device.

The light assembly 10 further defines a bottom casing assembly 14 extending from beneath the array of light elements 12 to a lower surface defined about a lens of the light element 12. In this manner, the connections 18 are encased within the overmold portion of casing assembly 14, thus generally securing the electrical components in place. The bottom casing assembly 14 may be made by injection molding of an elastomeric material as will be described further herein.

The light assembly 10 further defines a top casing 16 extending above the array of light elements 12 and into engagement with the bottom casing 16 to form a housing 21 that contains the array of light elements 12 therein. The top casing 16 may be made from a transparent or partially transparent material that allows light to penetrate to the ambient. Additionally, the top casing 16 may also be provided with heat dissipating characteristics for dissipating heat emanating from the light elements 12. As illustrated, casing 12 is shown formed from bottom portion 14 and top portion 16, though casing 12 may be integrally formed as a one piece design or have more than two portions as shown.

Figure 3:
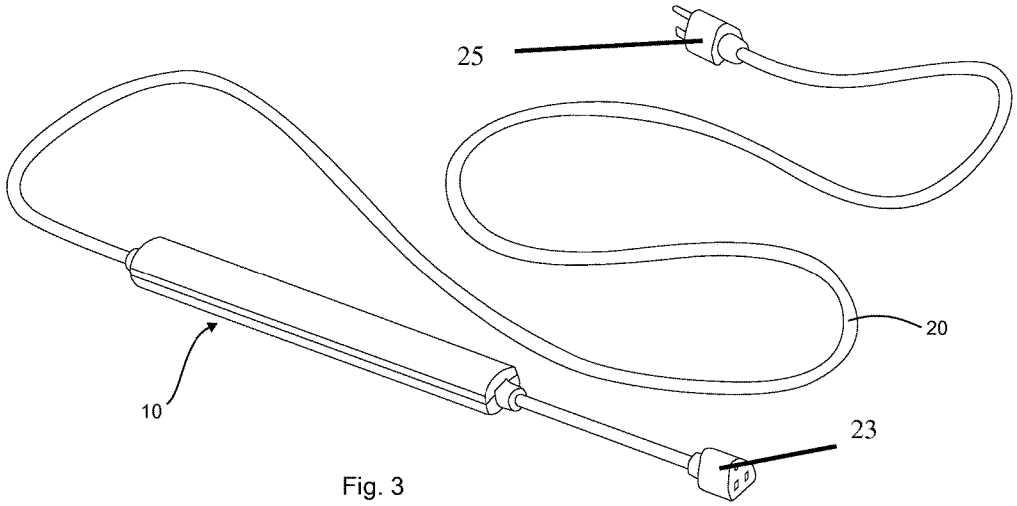
FIG. 3 illustrates a perspective view of a light assembly according to one or more embodiments disclosed herein.

One embodiment and construction of a light assembly 10 is illustrated in FIG. 3 where the light assembly 10 is depicted as a work light having a power cord 20 in electrical communication therewith. The cord 20 may further define respective female 23 and male 25 plug ends where the light assembly 10 may be used as a pass through for mains power for the purpose of an extension cord for attaching accessories, or serially connecting additional lighting assemblies. Alternatively, light assembly 10 may include a battery source that is integrated within the housing 21 for powering lights 12. A control driver or the like may also be provided for monitoring or regulating current flow to the lights 12.

Figure 4:
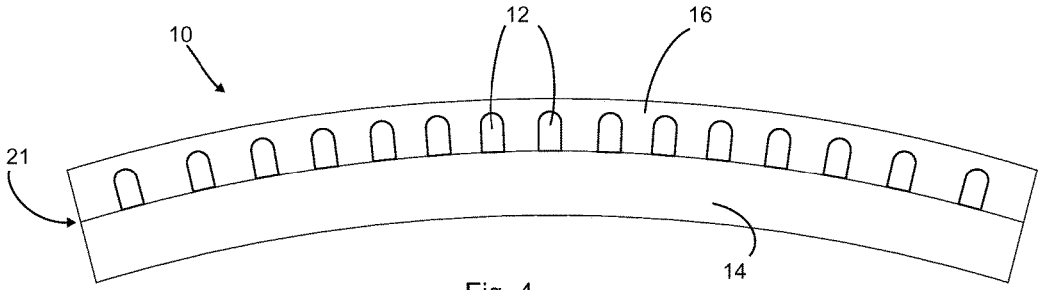
FIG. 4 illustrates a side view of a light assembly shown in a flexed state according to one or more embodiments disclosed herein.
Figure 5:
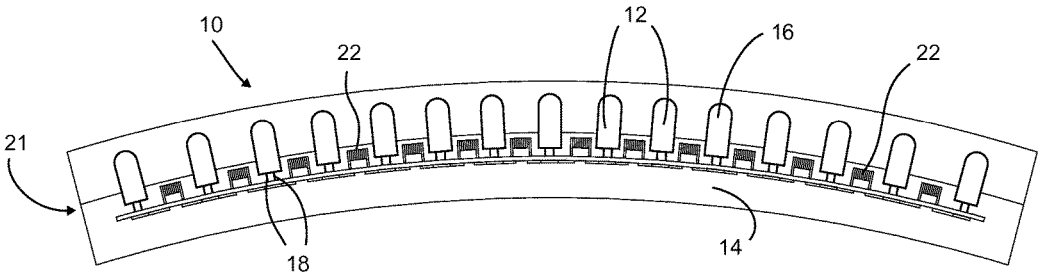
FIG. 5 illustrates a cross-sectional side view of a light assembly shown in a flexed state according to one or more embodiments disclosed herein.

Due to the elastomeric construction of casings 14 and 16 and the flexible connections made between adjacent light elements 12, the light assembly 10 may be flexed in each of the yaw, pitch, and roll directions. Alternatively, assembly 10 can be designed to be flexed in only one of each of the yaw, pitch, and roll directions. As illustrated in FIG. 4 and FIG. 5, the light assembly 10 is shown flexed in a convex arcuate shape along its elongate axis. Each light element 12 is able to flex relative to an adjacent light elements 12 by elongation, contraction, or bending of coil elements 22 in the embodiments illustrated in FIG. 4 and FIG. 5. In the embodiments illustrated, the housing 21 maintains structural integrity during bending.

Figure 6:
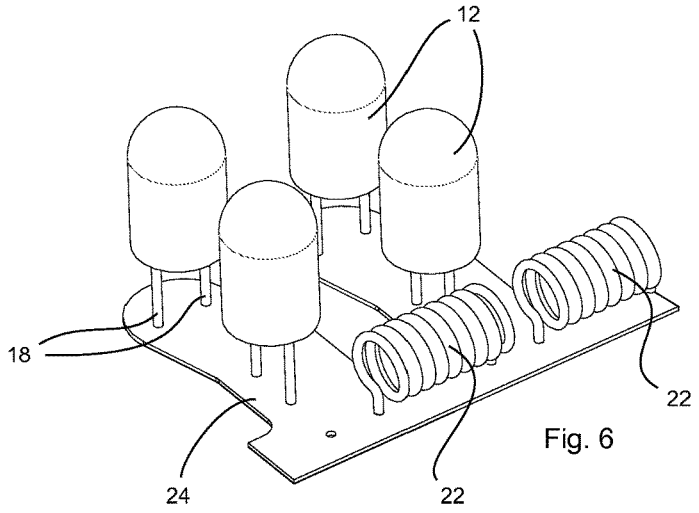
FIG. 6 illustrates a top facing, perspective view of a circuit board and light components according to one or more embodiments disclosed herein.
Figure 7:
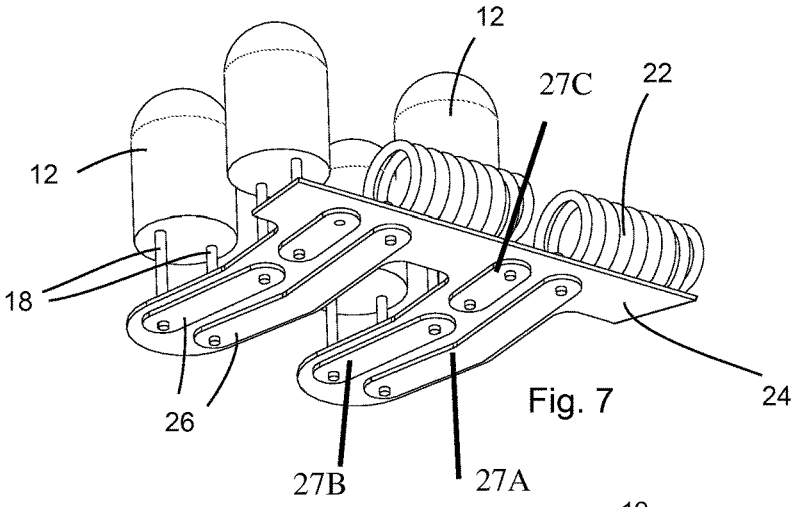
FIG. 7 illustrates a bottom facing, perspective view of a circuit board and light components according to one or more embodiments disclosed herein.
Figure 8:
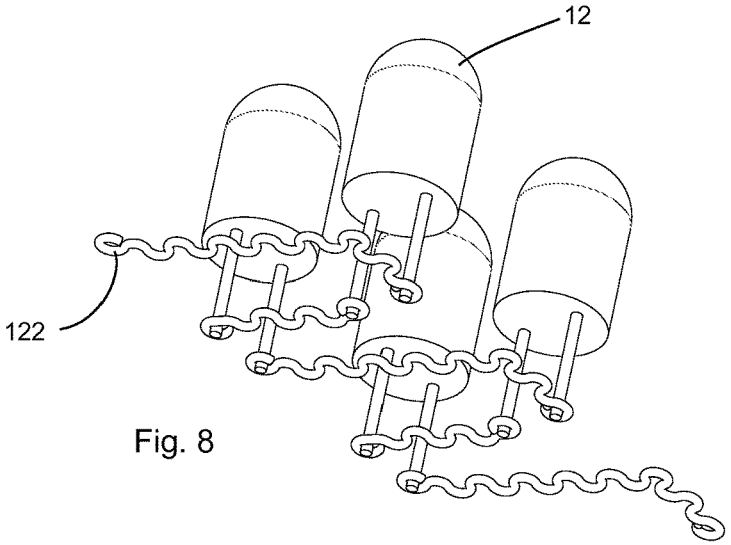
FIG. 8 illustrates a bottom facing, perspective view of a circuit board and light components according to one or more embodiments disclosed herein.

Enlarged views are shown in FIG. 6 and FIG. 7 of the circuitry components used herein. As illustrated, connection members 18 of a light element 12 extend into a flex circuit board 24 and are then engaged according to design specifications with circuit portions 26. Circuit portions 26 are configured for passing electrical current from connection 18 of light element 12 to connection 18 of an adjacent light element 12 and from each end of coil elements 22 as will be apparent from the drawings. As illustrated in FIG. 8, coil 22, flex circuit board 24, circuit portions 26, may be replaced with coil assemblies 122 as illustrated. In this embodiment, the coil assemblies 122 are also overmolded within bottom casing 14. Circuit portions 26 as illustrated define portions 27A, 27B, and 27C. These portions are formed as separate components as opposed to a continuous current carrying member in order to reduce the rigidity of the totality of the current carrying member to allow for bending, compared to a rigid structure where the member is continuous. As illustrated, portions 27A, 27B, and 27C extend generally perpendicular to the length of the assembly 10 such that bending where force is applied to respective ends of the assembly 10 is accommodated.

Figure 9:
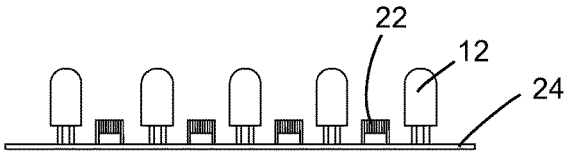
FIG. 9 illustrates an upstream step of a method where electrical components are assembled according to one or more embodiments disclosed herein.
Figure 10:
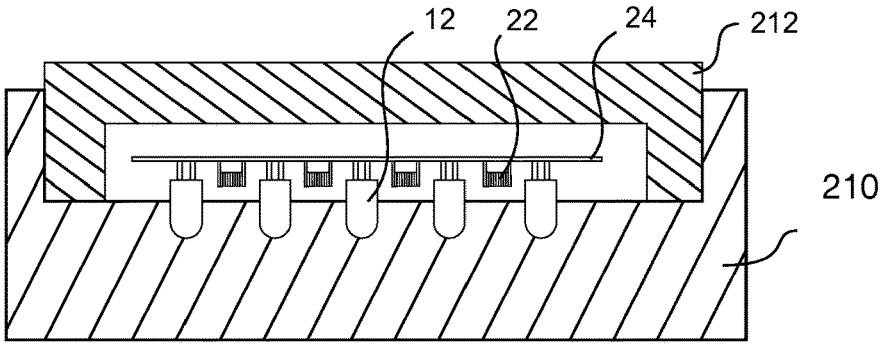
FIG. 10 illustrates a downstream step of a method of placing electrical components into a mold where at least a portion of the light lens is unexposed and molding around the components to form a bottom overmold according to one or more embodiments disclosed herein.
Figure 11:
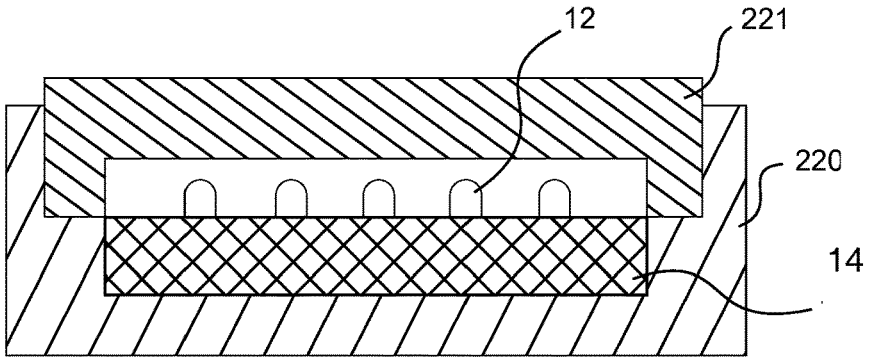
FIG. 11 illustrates a downstream step of a method of placing electrical components into a mold to form a top overmold according to one or more embodiments disclosed herein.
Figure 12:
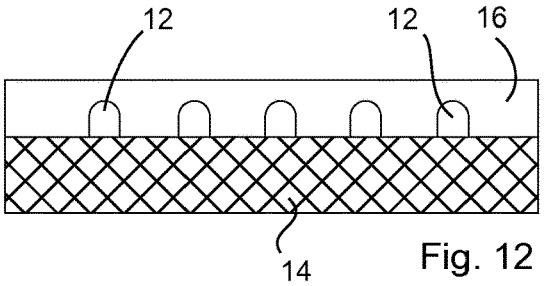
FIG. 12 illustrates a molded part where the top overmold and bottom overmold have been molded together to form a casing that has been removed from the mold according to one or more embodiments disclosed herein.

A method of making the assembly 10 is illustrated in the sequential views of FIG. 9, FIG. 10, FIG. 11, and FIG. 12. As illustrated, the method includes providing an array of light elements, where a respective light element is flexibly and electrically coupled to each adjacent light element as illustrated in FIG. 9. This may include entirely assembling each of the electrical components shown generally in FIG. 6 and FIG. 7. The method may include placing the array of light elements 12 within a first mold 210 where the light elements 12 are received within corresponding recesses in the mold 210 that are not in fluid communication with the injection area of the first mold 210 such that only a portion of the light elements are covered with injected material after the injection process. A corresponding mold portion 212 may be provided for sealing the second mold 220. The injection port is not illustrated but may be located in any appropriate location.

The method may then include injecting material into the first mold 212 to form the overmold bottom casing 14 assembly. The method may then include allowing the material to heat, removing the molded portion from mold 210, and then flipping the molded part and installing the molded assembly into a second mold 220. A corresponding mold portion 222 may be providing for sealing the second mold 220. The method may further include injecting material into the second mold 220 to form the overmold top casing assembly 16. Additional components as illustrated in the other drawings provided herein may also be provided during this molding step, such as the power cord shown in FIG. 3.

In one or more experiments, a product was designed according to the one or more embodiments disclosed herein and tested for a duration of several hours. In those experiments, it was determined that the temperature of the light assembly tapers off to a temperature that is stable and substantially cooler than incandescent light sources and similar to the output of a low power florescent bulb. Additionally, impact and drop testing shows that the light assembly can handle extreme realistic abuse.

For example, the lighting assembly can easily handle a drop from ten feet. It can withstand being thrown at a concrete surface. You can drive over it without damaging it. It can be struck against solid objects and still function. If this light were to be placed over a depression and force applied to the top of it, it would bend into the contour of the depression without a problem; then straighten out again. Any of these conditions would pose a high risk of damage to most other lighting products.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

We claim:

1. A rugged lighting assembly comprising:

an array of light elements, wherein a respective light element is flexibly coupled to each adjacent light element by a connector, wherein the connector includes a spring extending between adjacent circuit board portions to which respective light elements are electrically coupled thereto to provide flexibility and electrical connectivity between adjacent circuit board portions;

an overmold bottom casing assembly extending from beneath the array of light elements to a lower surface defined about a lens of the light element and enclosing the connector; and an overmold top casing extending above the array of light elements and into engagement with the overmold bottom casing to form a housing that contains the array of light elements therein, wherein the housing is flexible such that the array of lights are deformable while maintaining connection between adjacent light elements, wherein each of the light elements include connections extending therefrom and through respective openings the circuit board portions and into engagement with a current carrying member positioned on a side of the circuit board portion opposing the light element, and wherein the housing further contains each of the circuit board portions and each current carrying member.

2. The assembly of claim 1, further including a power cable in communication with the array of light elements and further configured for being in communication with an electrical power source.

3. The assembly of claim 2, further including a driver in series communication with the array of light elements and the power cable for controlling current to the array of light elements.

4. The assembly of claim 2, wherein the array of lights are in one of series or parallel communication.

5. The assembly of claim 1, wherein each adjacent light element is flexibly and electrically coupled by a coil assembly forming a portion of the connector.

6. The assembly of claim 5, wherein the overmold bottom casing and the overmold top casing have generally equal major dimensions.

7. The assembly of claim 1, wherein the array of light elements are light emitting diodes (LEDs).

8. The assembly of claim 1, wherein the overmold bottom casing is formed from an elastomer.

9. The assembly of claim 1, wherein the overmold top casing is formed from an elastomer.

10. The assembly of claim 1, wherein each adjacent light element is flexibly and electrically coupled by the connector, wherein the connector is capable of flexation and elongation such that the assembly may be bent in one or more of a yaw, pitch, and roll direction.

11. The assembly of claim 1, wherein the overmold top casing is at least partially transparent to allow light emitted from the array of lights to pass through.

12. The assembly of claim 1, wherein the housing is elongate.

13. The assembly of claim 1, wherein each respective light element of the light array is in series communication.

14. he assembly of claim 1, wherein the housing is water-tight.

15. The assembly of claim 1, wherein the overmold top casing is configured for dissipating heat.

* * * * *